US005279131A

United States Patent [19]

Urushihata et al.

[11] Patent Number: 5,279,131

[45] Date of Patent: Jan. 18, 1994

[54] MULTI-AIRCONDITIONER

[75] Inventors: Tadayuki Urushihata; Fumio Harada, both of Shimizu; Kenji Tokusa, Shizuoka; Fumihiko Kitani, Shimizu; Toshiyuki Hojo, Shimizu; Keij Tanaka, Shimizu; Kensaku Oguni, Shimizu, all of Japan

[73] Assignee: Hitachi, Ltd., Chiyoda, Japan

[21] Appl. No.: 743,499

[22] Filed: Aug. 9, 1991

[30] Foreign Application Priority Data

Aug. 10, 1990 [JP] Japan ..... 2-211880

[51] Int. Cl.[5] ..... F24F 11/00

[52] U.S. Cl. ..... 62/324.1; 62/117; 62/468

[58] Field of Search ..... 62/441, 324.1, 84, 117, 62/468

[56] References Cited

U.S. PATENT DOCUMENTS

| | | | |
|---|---|---|---|
| 2,336,671 | 12/1943 | Chambers | 62/468 |
| 2,796,740 | 6/1957 | McFarlan | 62/6 |
| 3,067,587 | 12/1962 | McFarlan | 62/441 |
| 4,104,890 | 8/1978 | Iwasaki | 62/324.1 |
| 4,277,952 | 7/1981 | Martinez, Jr. | 62/115 |
| 4,530,215 | 7/1985 | Kramer | 62/84 |
| 4,551,983 | 11/1985 | Atsumi et al. | 62/174 |
| 4,750,337 | 6/1988 | Glamm | 62/468 |
| 4,771,610 | 9/1988 | Nakashima et al. | 62/160 |
| 4,862,705 | 9/1989 | Nakamura et al. | 62/324.1 |
| 4,878,357 | 11/1989 | Sekigami et al. | 62/160 |
| 5,065,588 | 11/1991 | Nakayama et al. | 62/160 |

FOREIGN PATENT DOCUMENTS 2122335 1/1984 United Kingdom .

OTHER PUBLICATIONS

British Search Report–Application No. 9117013.4

*Primary Examiner*—Albert J. Makay
*Assistant Examiner*—William C. Doerrler
*Attorney, Agent, or Firm*—Antonelli, Terry, Stout & Kraus

[57] ABSTRACT

Disclosed is a multi-airconditioner including a plurality of outdoor units and at least one indoor units in which refrigerant conduits connecting the outdoor units and the at least one indoor units are united in the form of two or three conduits. In the case of the multi-airconditioner for effecting either room-cooling or room-heating, each of the outdoor units and each of the indoor units have a liquefied refrigerant conduit and a gasified refrigerant conduit, which are connected with a single common liquefied refrigerant conduit and a single common gasified refrigerant conduit, respectively. In the case of the multi-conditioner for effecting simultaneous room-cooling and room-heating operation in which some of the indoor units are under room-cooling operation while the other indoor units are under room-heating operation, each outdoor unit and each indoor unit have a liquefied refrigerant conduit, a high-pressure gasified refrigerant conduit and a low-pressure gasified refrigerant conduit, and these liquefied refrigerant conduits, high-pressure gasified refrigerant conduits and low-pressure gasified refrigerant conduits are connected to a single common liquefied refrigerant conduit, a single common high-pressure gasified refrigerant conduit and a single common low-pressure gasified refrigerant conduit, respectively.

8 Claims, 11 Drawing Sheets

MULTI-AIRCONDITIONER

BACKGROUND OF THE INVENTION

1. Field of the Invention

The present invention relates to a multi-airconditioner including a plurality of outdoor units and a plurality of indoor units and, more particularly, it relates to uniting of refrigerant conveying conduits which connect the outdoor units and the indoor units of the multi-airconditioner.

2. Description of the Prior Art

In a multi-airconditioner including a plurality of outdoor units, a plurality of indoor units and refrigerant conveying conduits therebetween, it has been heretofore required to provide a plurality of refrigerant conveying conduits for every group of the indoor units connected with each outdoor unit. Japanese Patent Application Laid-Open No. Sho 56-49856 discloses an example of the multi-airconditioner of this kind.

In the conventional multi-airconditioner of this kind, the total number of the coolant conveying conduits connected between the outdoor units and the indoor units, as a whole, is equal to the sum of the conduits contained in the respective groups. Therefore, as the number of the outdoor units increases, the number of the conduits increases accordingly. The increase of the number of the conduits gives rise to several inconvencences. For example, the piping work becomes complicated and the cost of the piping work is increased, depending upon the increase of the number of conduits used. Available space in a building is decreased owing to increase of volume of a shaft required for piping.

OBJECT OF THE INVENTION

It is an object of the present invention to provide a multi-airconditioner in which the refrigerant conveying conduits connected between the outdoor units and the indoor units are united into two or three conduits, irrespectively of the number of the outdoor units and/or the indoor units, thereby simplifying the piping work required, decreasing the amount of the conduits used, and enabling effective use of space in a building.

It is another object of the present invention to provide a multi-airconditioner in which refrigerant conveying conduits connecting the outdoor units and the indoor units are united together, thereby enabling easy increasing or decreasing of the number of the outdoor units and/or indoor units.

SUMMARY OF THE INVENTION

In accordance with the present invention there is provided a multi-airconditioner including a plurality of outdoor units and at least one indoor unit, each of said outdoor units and each of said indoor units including a liquefied refrigerant conduit and a gasified refrigerant conduit, in which the liquefied refrigerant conduits and the gasified refrigerant conduits of the respective outdoor units and the liquefied refrigerant conduits and the gasified refrigerant conduits of the respective indoor units are connected with a common liquefied refrigerant conduit and a common gasified refrigerant conduit, respectively.

In accordance with the present invention, there is further provided a multi-airconditioner including a plurality of outdoor units and at least one indoor unit, each of said outdoor units and each of said indoor units including a liquefied refrigerant conduit, a high-pressure gasified refrigerant conduit and a low-pressure gasified refrigerant conduit, in which the liquefied refrigerant conduits, the high-pressure gasified refrigerant conduits and the low-pressure gasified refrigerant conduits of the respective outdoor units and the liquefied refrigerant conduit, the high-pressure gasified refrigerant conduits and the low-pressure gasified refrigerant conduits of the respective indoor units are connected with a common liquefied refrigerant conduit, a common high-pressure gasified refrigerant conduit and a common low-pressure gasified refrigerant conduit, respectively.

In accordance with the present invention, there is further provided a multi-airconditioner including a plurality of outdoor units and at least one indoor unit, each of said outdoor units having a refrigerant delivering conduit and a refrigerant returning conduit, each of said indoor units having a liquefied refrigerant conduit and a gasified refrigerant conduit, in which the refrigerant delivering conduit and the refrigerant returning conduit of each of the outdoor units are connected to a common refrigerant delivering conduit and a common coolant returning conduit, respectively, said common refrigerant delivering conduit and said common refrigerant returning conduit being connected, at their indoor unit side, to a gas-liquid separator which serves to separate the refrigerant fed from the common refrigerant delivering conduit into a gas phase refrigerant and a liquid phase refrigerant when said refrigerant contains the gas phase refrigerant and the liquid phase refrigerant, said gas-liquid separator being connected to the liquefied refrigerant conduits and the gasified refrigerant conduits of the respective indoor units.

In accordance with an embodiment of the present invention, there is provided a multi-airconditioner in which the conduits of the respective outdoor units are connected to said common conduits through headers, respectively.

In accordance with another embodiment of the present invention, there is provided a multi-airconditioner including an oil-separator connected to the discharging pipe of a compressor in each of the outdoor units, and a pressure equalizing pipe and an oil equalizing pipe connected between the oil separators of the respective outdoor units.

In accordance with a further embodiment of the present invention, there is provided a multi-airconditioner in which an outside oil feeding system is used to feed oil to the compressor in each of the outdoor units, and a pressure equalizing pipe and an oil equalizing pipe are connected between the oil separators of the respective outdoor units.

According to the multi-airconditioner as described above, the refrigerant is conveyed between a plurality of outdoor units and a plurality of indoor units through two common conduits, that is, the common liquefied refrigerant conduit and the common gasified refrigerant conduits, or three common conduits, that is, the common liquefied refrigerant conduit, the common high-pressure gasified refrigerant conduit and the common low-pressure gasified refrigerant conduit. Thus the refrigerant conveying conduits can be united together, thereby providing a compact conduit system.

DESCRIPTION OF THE PREFERRED EMBODIMENTS OF THE INVENTION

Figure 1:
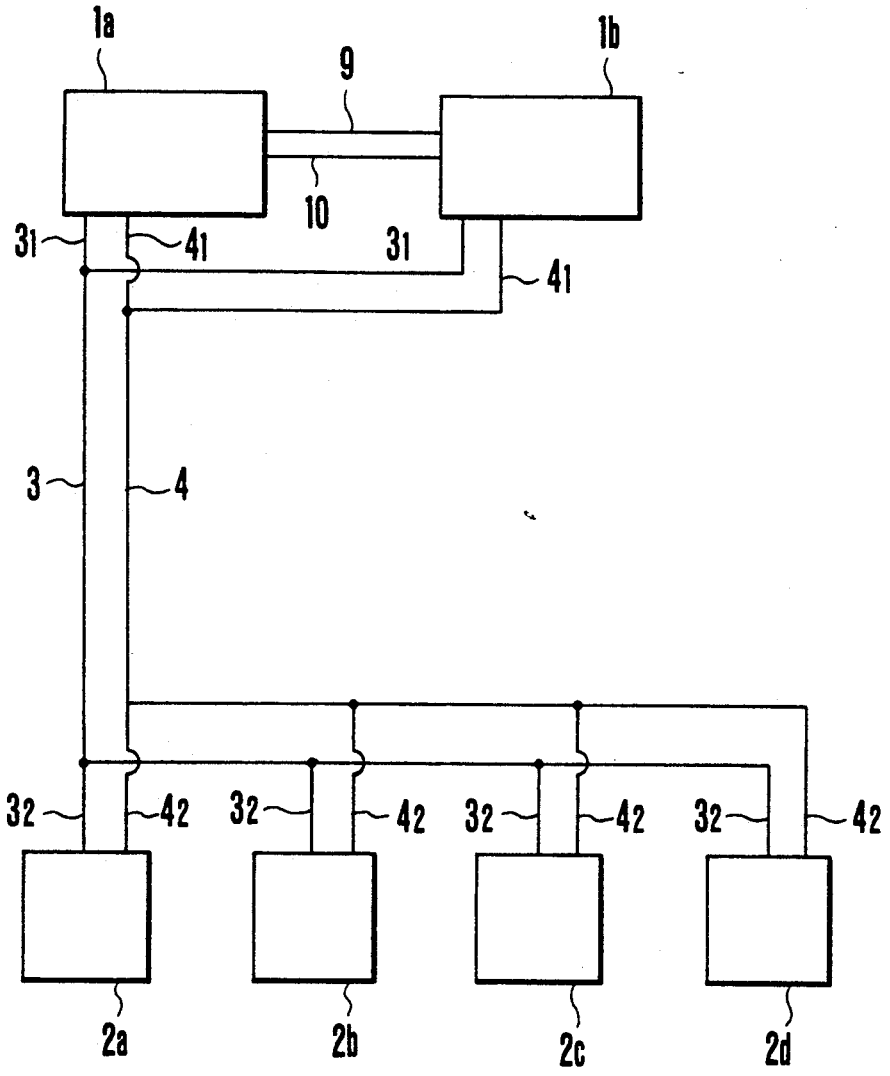
FIG. 1 is a diagram showing an embodiment of the present invention.

Now the present invention will be explained with reference to the preferred embodiments illustrated in the drawings.

FIG. 1 illustrates an arrangement of an embodiment of the multi-airconditioner including a plurality of outdoor units 1*a* and 1*b* and a plurality of indoor units 2*a*, 2*b*, 2*c* and 2*d*, in which refrigerant conveying conduits connecting the outdoor units and the indoor units are united together into two conduits. Each of the outdoor units has a liquefied refrigerant conduit $3_1$ and a gasified refrigerant conduit $4_1$ and each of the indoor units 2*a*, 2*b*, 2*c* and 2*d* has a liquefied refrigerant conduit $3_2$ and a gasified refrigerant conduit $4_2$. The liquefied refrigerant conduits $3_1$ and the gasified refrigerant conduits $4_1$ of the outdoor units 1*a* and 1*b* and the liquefied refrigerant conduits $3_2$ and the gasified refrigerant conduits $4_2$ of the indoor units 2*a*, 2*b*, 2*c* and 2*d* are connected to a common liquefied refrigerant conduit 3 and a common gasified refrigerant conduit 4, which are common to the outdoor and indoor units, respectively, to convey the refrigerant from the outdoor units to the indoor units and vice versa. The outdoor units 1*a* and 1*b* are connected together by means of a pressure equalizing pipe 9 and an oil equalizing pipe 10, to prevent occurrence of imbalance of oil amounts fed to the compressors of the respective outdoor units.

Figure 2:
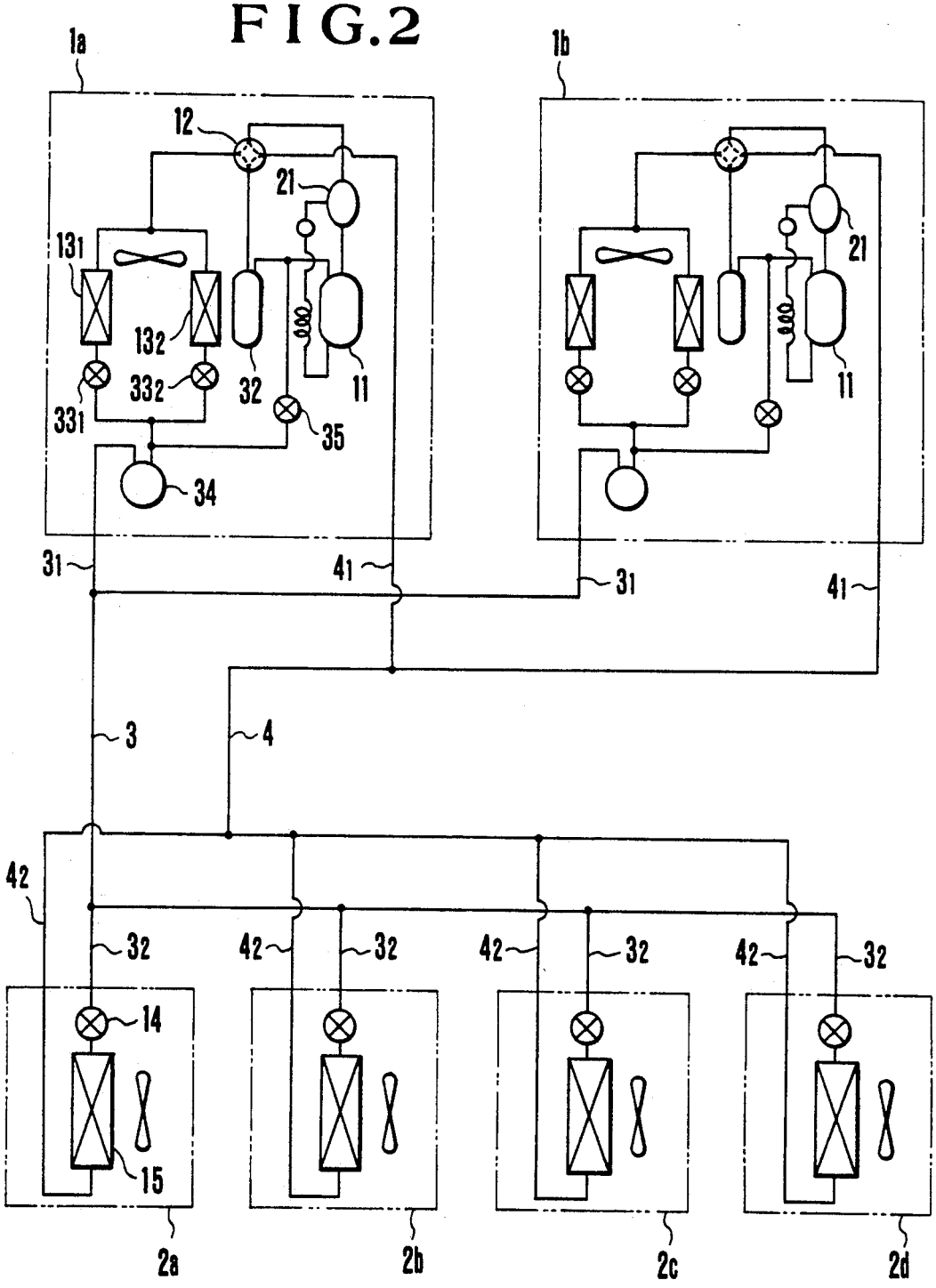
FIG. 2 illustrates an arrangement of a refrigerating cycle of the embodiment shown in FIG. 1.

FIG. 2 illustrates a refrigerating cycle of the arrangement shown in FIG. 1. As shown in FIG. 2, each of the outdoor units 1*a* and 1*b* includes a compressor 11, a four-way valve 12 for switching a room cooling operation and a room heating operation, bi-sected outdoor heat exchangers $13_1$ and $13_2$, adjustable electronic expansion valves $13_2$ and $33_2$ for the heat exchangers, a receiver 34 and an accumulator 32. A liquefied refrigerant returning passage having a flow rate adjusting valve 35 connects the receiver 34 with the gas inlet side of the compressor 11. Each of the indoor units 2*a*, 2*b*, 2*c* and 2*d* has an indoor heat exchanger 15 and an adjustable electronic expansion valve 14. The pressure equalizing pipe 9 and the oil equalizing pipe 10 are not shown in FIG. 2, but the details thereof will be explained with reference to FIG. 5.

In this embodiment, all of the indoor units are in either one of the room heating operation or the room cooling operation (including the case where any unit or units are not in operation). The description will be made with reference to the operation of the outdoor unit 1*a*, for example, but the operation of the other outdoor unit is same as that of the unit 1*a*.

In the room cooling operation, the high temperature and high pressure gasified refrigerant discharged from the compressor 11 of the outdoor unit 1*a* passes through the four-way valve 12 to the outdoor heat exchangers $13_1$ and $13_2$, which act to exchange the heat of the gasified refrigerant with that of the outdoor air, whereby the gasified refrigerant becomes a liquefied refrigerant. (In this instance, the outdoor electronic expansion valves $33_1$ and $33_2$ are held in fully open state.) The liquefied refrigerant thus formed passes through the receiver 34, the liquefied refrigerant conduit $3_1$ and the common liquefied refrigerant conduit 3. Then the liquefied refrigerant is divided into the liquefied refrigerant conduits $3_2$ of the respective indoor units under operation.

In each liquefied refrigerant conduit, the electronic expansion valve 14 acts to reduce the pressure of the liquefied refrigerant, and the indoor heat exchanger 15 acts to exchange the heat of the refrigerant with that of the air in the room, whereby the refrigerant becomes a low-pressure gaseous refrigerant. The low-pressure gasified refrigerants passing through the gasified refrigerant conduits $4_2$ of the respective indoor units join together into the common gasified refrigerant conduit 4. The gasified refrigerant passing through the common conduit 4 passes through the gasified refrigerant conduit $4_1$ of the outdoor unit 1*a*, the four-way valve 12, the accumulator 32 and returns to the compressor 11. The compressor 11 acts to compress the gasified refrigerant to form a high temperature and high pressure gaseous refrigerant, which is discharged from the compressor again.

The room heating operation is as follows. The high temperature and high pressure gaseous refrigerant discharged from the compressor 11 of the outdoor unit 1*a* passes through the four-way valve 12, the gasified refrigerant conduit $4_1$, the common gasified refrigerant conduit 4. Then the gasified refrigerant is divided into the gasified refrigerant conduits $4_2$ of the respective indoor units under operation. In each gasified refrigerant conduit, the indoor heat exchanger 15 acts to exchange the heat of the gaseous refrigerant with that of the air in the room, whereby the refrigerant becomes a liquefied refrigerant. (In this instance, all of the indoor electronic expansion valves 14 are held in fully open state.) The liquefied refrigerants passing through the respective liquefied refrigerant conduits $3_2$ join together into the common liquefied refrigerant conduit 3. Then the liquefied refrigerant passes through the liquefied refrigerant conduit $3_1$ of the outdoor unit 1*a*, the receiver 34 to the outdoor electronic expansion valves $33_1$ and $33_2$, which act to reduce the pressure of the liquefied refrigerant. The outdoor heat exchangers 13, and $13_2$ act to exchange the heat of the liquefied refrigerant with that of the outdoor air, whereby the liquefied refrigerant becomes a low-pressure gaseous refrigerant. The low-pressure gasified refrigerant thus formed passes through the four-way valve 12 and the accumulator 32 and returns to the compressor 11, from which it is discharged again.

In any case of the room heating operation and the room cooling operation as described above, the electronic expansion valve 14 of the indoor unit which is not in operation is held closed. Referring to the plurality of outdoor units, all of the outdoor units may be operated or a part of them may be operated simultaneously. Referring to the heat exchangers $13_1$ and $13_2$ of the outdoor unit, both of them or one of them may be operated during operation of the outdoor unit. (When one of them is operated, one of the electronic expansion valves $33_1$ and $33_2$ is closed.) The selection and the combination of these elements are controlled, depending upon the room heating or room cooling load required in the particular case. The indoor expansion valves 14 are controlled to properly distribute the refrigerant to the respective indoor units, depending on the heating or cooling loads in the respective rooms. The flow rate adjusting valve 35 in the outdoor unit acts to adjust the flow rate of the liquefied refrigerant returned to the compressor 11, thereby controlling the temperature of the gaseous refrigerant discharged from the compressor 11.

Figure 3:
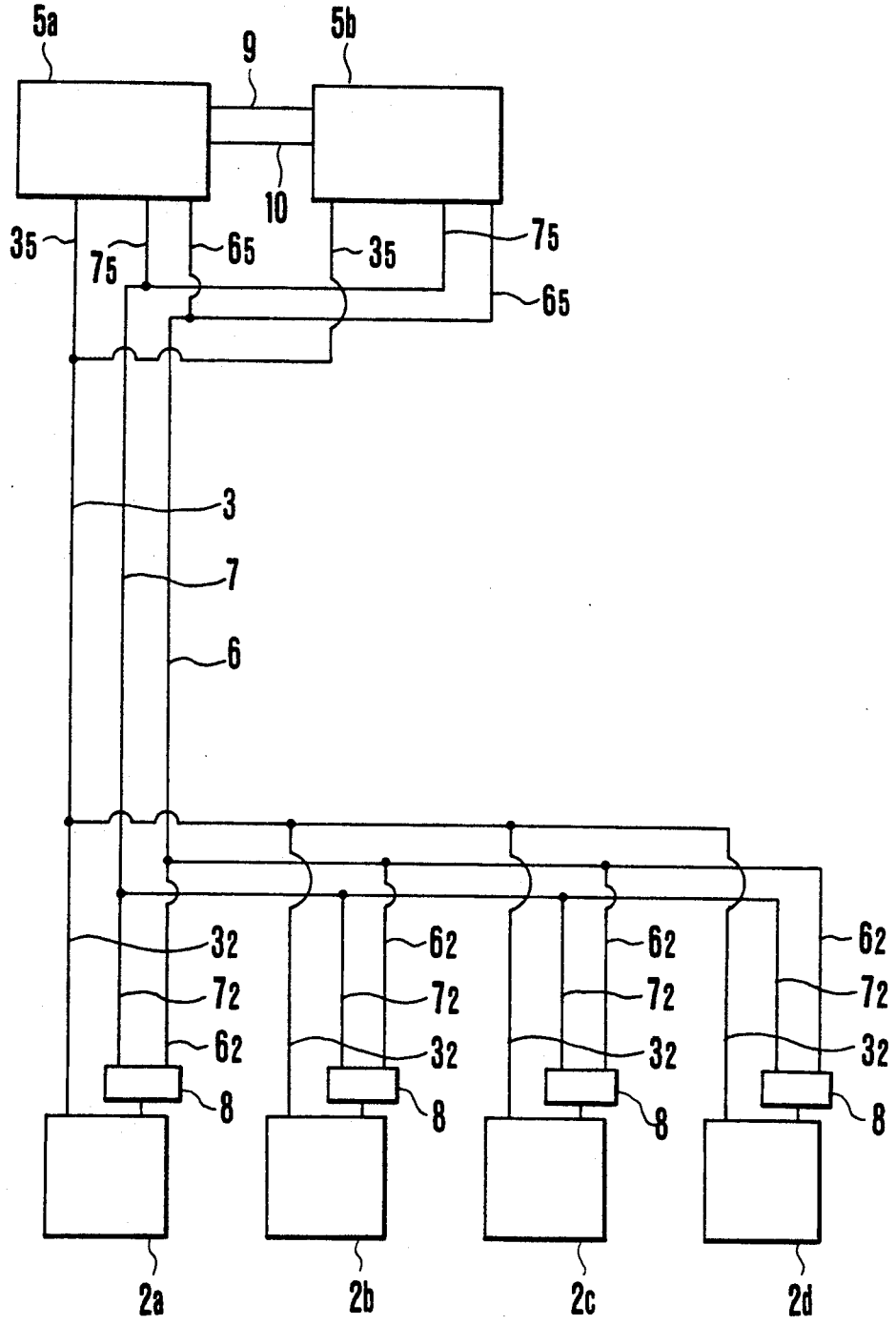
FIG. 3 is a diagram showing another embodiment of the present invention.

FIG. 3 illustrates an embodiment of a multi-airconditioner in which refrigerant conveying conduits connected between a plurality of outdoor units and a plurality of indoor units are united together into three conduits. Each of outdoor units 5*a* and 5*b* includes a liquefied refrigerant conduit $3_5$, a high-pressure gasified refrigerant conduit $6_5$ and a low-pressure gasified refrigerant conduit $7_5$. Each of indoor units 2*a*, 2*b*, 2*c* and 2*d* includes a liquefied refrigerant conduit $3_2$, a high-pressure gasified refrigerant conduit $6_2$ and a low-pressure gasified refrigerant conduit $7_2$. The conduits $3_5$, $6_5$ and $7_5$ of the outdoor units and the conduits $3_2$, $6_2$ and $7_2$ of the indoor units are connected to a common liquefied refrigerant conduit 3, a common high-pressure gasified refrigerant conduit 6 and a common high-pressure gasified refrigerant conduit 7, respectively, whereby the refrigerant is conveyed between the outdoor units and the indoor units. The outdoor units 5*a* and 5*b* are communicated with each other through a pressure equalizing pipe 9 and an oil equalizing pipe 10, which serve to hold balance of amounts of oil fed to the compressors of the respective outdoor units.

Figure 4:
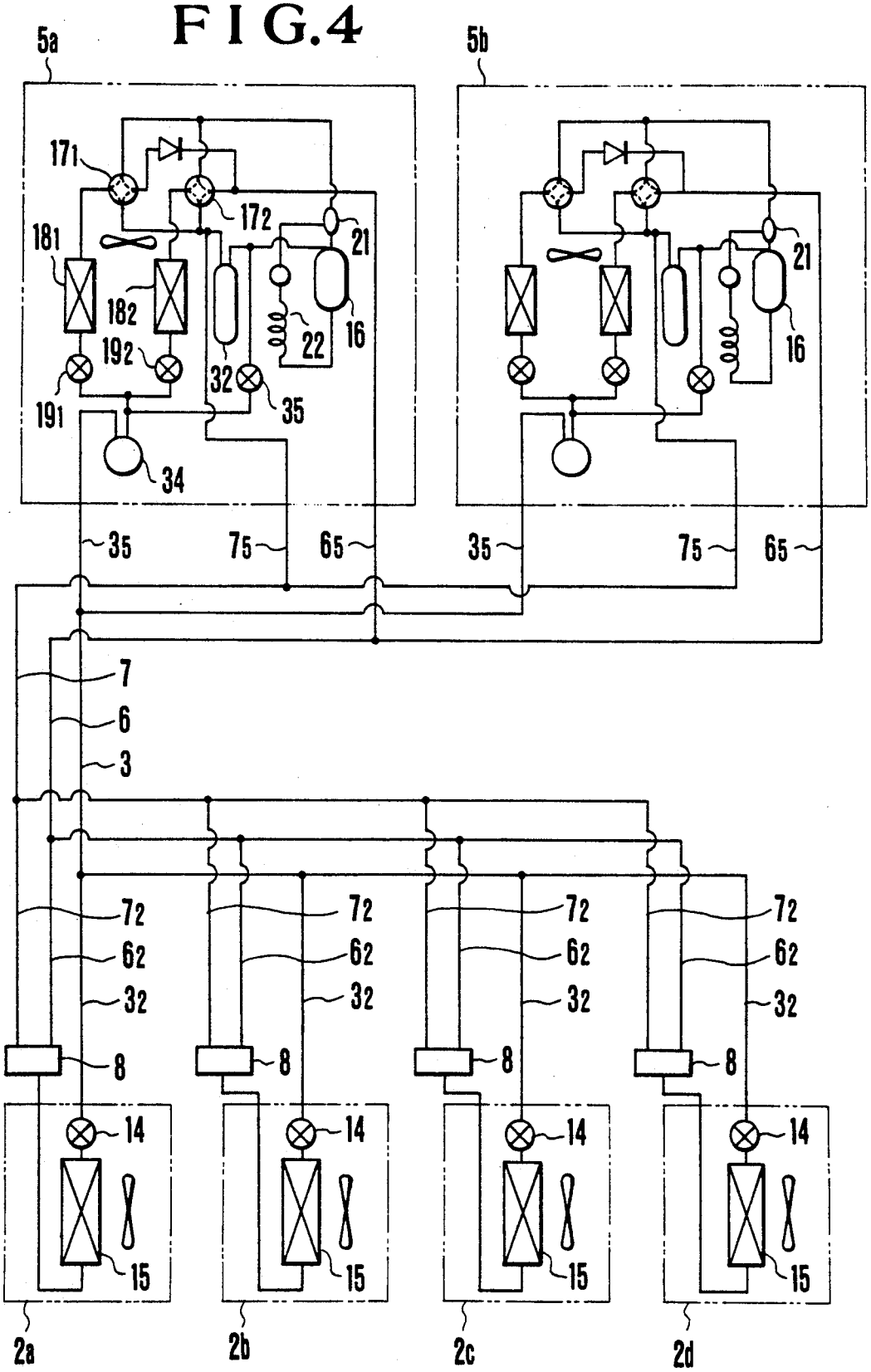
FIG. 4 illustrates an arrangement of a refrigerating cycle of the embodiment shown in FIG. 3.

FIG. 4 illustrates an arrangement of a refrigerating cycle of the multi-airconditioner shown in FIG. 3. As shown in FIG. 4, each of the outdoor units 5*a* and 5*b* includes a compressor 16, two four-way valves $17_1$ and $17_2$, bi-sected outdoor heat exchangers $18_1$ and $18_2$, electronic expansion valves $19_1$ and $19_2$, a receiver 34 and an accumulator 32. A liquefied refrigerant passage having a flow rate adjusting valve 35 is connected between the receiver 34 and the inlet side of the compressor 16. In FIG. 4, the pressure equalizing pipe 9 and the oil equalizing pipe 10 are not shown but they will be hereinafter described with reference to FIG. 5. Each of the indoor units 2*a*, 2*b*, 2*c* and 2*d* has an adjustable electronic expansion valve 14 and an indoor heat exchanger 15. An indoor room heating-cooling switching unit 8 is arranged in each indoor unit.

In this embodiment, it is possible to effect room-heating operation of at least one of the indoor units, while effecting room-cooling operation of the other indoor units (so-called simultaneous cooling-heating operation), or to effect room-heating or room-cooling operation of all indoor units (including the case where one or more indoor units are not in operation). In each of the indoor units which are in the room-cooling operation, the indoor cooling-heating switching unit 8 is switched in such state that the low-pressure gasified refrigerant conduit $7_2$ is communicated with the indoor heat exchanger 15. In each of the indoor units which are in the room-heating operation, the indoor cooling-heating switching unit 8 is switched in such state that the high-pressure gasified refrigerant conduit $6_2$ is communicated with the indoor heat exchanger 15 and the electronic expansion valve 14 is held in its fully open state. The electronic expansion valve of the non-operating indoor unit is held in its fully closed state. In the following explanation of this embodiment, the description will be made with reference to the operation of the outdoor unit 5*a*, for example, but the operation of the other outdoor unit is same as that of the outdoor unit 5*a*.

Firstly, the description will be made to the case where the simultaneous room-heating and room-cooling operation is effected and, as a whole, the room-cooling load is heavier than the room-heating load.

The high-temperature and high-pressure gaseous refrigerant discharged from the compressor 16 of the outdoor unit 5*a* is divided by the four-way valves $17_1$ and $17_2$ into the refrigerant portion for room-cooling and that for room-heating. The gaseous refrigerant portion for room-cooling is conducted through the four-way valve $17_1$ into the outdoor heat exchanger $18_1$, which acts to exchange the heat of the refrigerant with that of the outdoor air, whereby the gaseous refrigerant becomes a liquefied refrigerant. (In this instant, the outdoor electronic expansion valve $19_1$ is held in its fully open state.) The liquefied refrigerant passes through the receiver 34, the liquefied refrigerant conduit $3_5$ of the outdoor unit 5*a* and the common liquefied refrigerant conduit 3 and joins with the liquefied refrigerant coming from the indoor unit or units under room-heating operation as hereinafter described. Then said liquefied refrigerant is divided into the respective liquefied refrigerant conduits $3_2$ of the indoor units under room-cooling operation. In each liquefied refrigerant conduit of the indoor unit under room-cooling operation, the indoor expansion valve 14 acts to reduce the pressure of the liquefied refrigerant, and the indoor heat exchanger 15 acts to exchange the heat of the refrigerant with that of the air in the room, whereby the refrigerant becomes a low-pressure gaseous refrigerant. This low-pressure gasified refrigerant passes through the room cooling-heating switching unit 8, the low-pressure gasified refrigerant conduit $7_2$ and joins into the common low-pressure gasified refrigerant conduit 7. Then the gasified refrigerant passes through the low-pressure gasified refrigerant conduit $7_5$ of the outdoor unit 5*a* and the accumulator 32 and returns to the inlet side of the compressor 16, which acts to compress and discharge the refrigerant again.

On the other hand, the high-temperature and high-pressure gasified refrigerant portion for room heating is conducted by the four-way valve $17_2$ into the high-pressure gasified refrigerant conduit $6_5$. Then the refrigerant passes through the common high-pressure gasified refrigerant conduit 6 into the high-pressure gasified refrigerant conduits $6_2$ of the respective indoor units under room-heating operation. In each conduit $6_2$, the gasified refrigerant passes through the cooling-heating switching unit 8 to the indoor heat exchanger 15, which acts to exchange the heat of the refrigerant with that of the air in the room, whereby the the refrigerant becomes a liquefied refrigerant. The liquefied refrigerant passes through the electronic expansion valve 14 (which is in fully open state) and the liquefied refrigerant conduit $3_2$ to the common liquefied refrigerant conduit 3, where the liquefied refrigerant joins with the liquefied refrigerant which comes from the receiver 34. Then, the refrigerant is used to effect the room-cooling in the indoor units under room-cooling operation, as described above. The refrigerant becomes a low-pressure gasified refrigerant, which returns to the inlet side of the compressor 16 through the path as described above.

Next, the description will be made to the case where the simultaneous room-heating and room-cooling operation is effected and, as a whole, the room-heating load is heavier than the room-cooling load.

The high-temperature and high-pressure gasified refrigerant discharged from the compressor 16 of the outdoor unit 5*a* passes through the four-way valve $17_2$, the high-pressure gasified refrigerant conduit $6_5$, and the common high-pressure gasified refrigerant conduit 6 and then passes into the gasified refrigerant conduits $6_2$ of the respective indoor units under room-heating operation. In each conduit $6_2$, the gasified refrigerant passes through the cooling-heating switching unit 8 to the indoor heat exchanger 15, which acts to exchange the heat of the refrigerant with that of the air in the room, whereby the gasified refrigerant becomes a liquefied refrigerant. The liquefied refrigerant passes through the indoor expansion valve 14 (which is held in fully open state) of the corresponding indoor unit and the liquefied refrigerant conduit $3_2$ and joins into the common liquefied refrigerant conduit 3.

Then, a part of said liquefied refrigerant passes into the liquefied refrigerant conduit or conduits $3_2$ of the indoor unit or units under room-cooling operation. In the liquefied refrigerant conduit $3_2$, the indoor electronic expansion valve 14 acts to reduce the pressure of the liquefied refrigerant, and the indoor heat exchanger 15 acts to exchange the heat of the refrigerant with that of the air in the room, whereby the liquefied refrigerant becomes a low-pressure gasified refrigerant. The low-pressure gasified refrigerant passes through the cooling-heating switching unit 8 and the low-pressure gasified refrigerant conduit $7_2$ and joins into the common low-pressure gasified refrigerant conduit 7. Then the gasified refrigerant passes through the low-pressure gasified refrigerant conduit $7_5$ and the accumulator 32 and returns to the inlet side of the compressor 16.

On the other hand, the other part of said liquefied refrigerant passing through the common liquefied refrigerant conduit 3 passes to the liquefied refrigerant conduit $3_5$ of the outdoor unit 5*a* and the receiver 34. Then, the outdoor electronic expansion valve $19_2$ acts to reduce the pressure of the refrigerant, and the outdoor heat exchanger $18_2$ acts to exchange the heat of the refrigerant with the outdoor air, whereby the refrigerant becomes a low-pressure gasified refrigerant. The low-pressure gasified refrigerant thus formed passes through the four-way valve $17_2$ and joins with the low-pressure gasified refrigerant which comes from the above-mentioned low-pressure gasified refrigerant conduit $7_5$. Then the refrigerant passes through the accumulator 32 and returns to the inlet side of the compressor which acts to compress the refrigerant again and discharge it.

Next, the description will be made to the case where all of the indoor units are under room-cooling operation. The gasified refrigerant discharged from the compressor 16 passes through the four way valves $17_1$ and $17_2$ to the outdoor exchangers $18_1$ and $18_2$, which act to exchange the heat of the gasified refrigerant with the outdoor air, whereby the gasified refrigerant becomes a liquefied refrigerant. The liquefied refrigerant passes through the fully opened electronic expansion valves $19_1$ and $19_2$, the receiver 34, the liquefied refrigerant conduit $3_5$, the common liquefied refrigerant conduit 3 to the indoor units. The liquefied refrigerant is divided into the liquefied refrigerant conduits $3_2$ of the respective indoor units. In each of the liquefied refrigerant conduits, the indoor electronic expansion valve 14 acts to reduce the pressure of the refrigerant, and the indoor heat exchanger 15 acts to exchange the heat of the refrigerant with that of the air in the room, whereby the refrigerant becomes a low-pressure gasified refrigerant. The low-pressure gasified refrigerant passes through the cooling-heating switching unit 8 and the low-pressure gasified refrigerant conduit $7_2$ and joins into the common low-pressure gasified refrigerant conduit 7. Then the refrigerant passes through the low-pressure gasified refrigerant conduit $7_5$ and the accumulator 32 into the compressor 16.

Lastly, the description will be made to the case where all of the indoor units are under room-heating operation. The gasified refrigerant discharged from the compressor 16 passes through the four-way valves $17_1$ and $17_2$, the high-pressure gasified refrigerant conduit $6_5$, the common high-pressure gasified refrigerant conduit 6 to the indoor units. The refrigerant is divided to the high-pressure gasified refrigerant conduits $6_2$. In each conduit $6_2$, the refrigerant passes through the cooling-heating switching unit 8 to the indoor heat exchanger 15, which acts to exchange the heat of the refrigerant with that of the air in the room, whereby the refrigerant becomes a liquefied refrigerant. The liquefied refrigerant passes through the corresponding electronic expansion valve 14, which is held in fully open state, and the liquefied refrigerant conduit $3_2$ and joins into the common liquefied refrigerant conduit 3. Then, the liquefied refrigerant passes through the common liquefied refrigerant conduit $3_5$ of the outdoor unit and the receiver 34 to the outdoor electronic expansion valves $19_1$ and $19_2$, which act to reduce the pressure of the refrigerant. The outdoor heat exchangers $18_1$ and $18_2$ act to exchange the heat of the refrigerant with that of the outdoor air, whereby the refrigerant becomes a low-pressure gasified refrigerant, which passes through the four-way valves $17_1$ and $17_2$ and the accumulator 32 into the compressor 16.

In the embodiment as described above, the indoor electronic expansion valve of the non-operating indoor unit is held in its closed state. All of the plurality of the outdoor units may be operated or some of them may be operated simultaneously. Referring to the heat exchangers $18_1$ and $18_2$ of the outdoor unit under operation, both of them may be operated or one of them may be operated. The selection and the combination of these matters can be decided, depending upon the room cooling or room heating load required in a particular case. The indoor expansion valves are controlled to properly distribute the refrigerant to the respective indoor units, depending on the heating or cooling loads in the respective rooms. The flow rate adjusting valve 35 in the outdoor unit acts to adjust the flow rate of the liquefied refrigerant returned to the compressor 16 thereby controlling the temperature of the gaseous refrigerant discharged from the compressor 16.

In the case of simultaneous cooling and heating operation, the heat recovering cycle is formed, as described above, so that it is sufficient for the compressor to provide a work corresponding to the difference between the room-heating load and the room-cooling load, whereby energy saving can be achieved.

Figure 5:
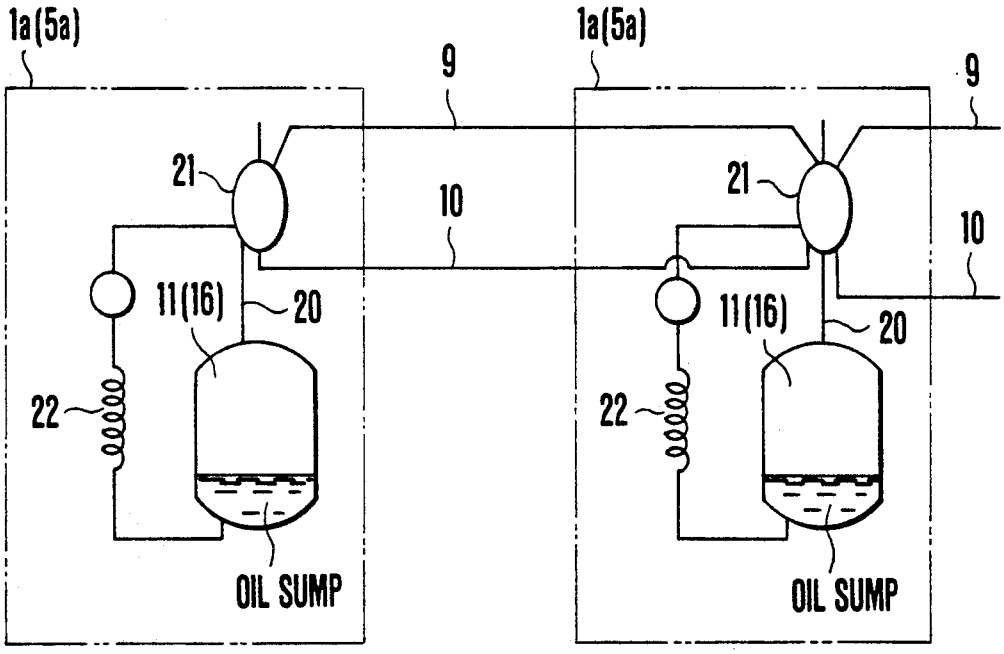
FIG. 5 is a diagram showing an oil amount equalizing system for equalizing oil feeding amount between the respective outdoor units.

FIG. 5 is an enlarged view showing a device for avoiding imbalance between amounts of oil fed to the compressors in the respective indoor units, in each embodiment as explained above. The compressor 11 (or 16) of each outdoor unit has its discharge pipe 20 connected with an oil separator 21. The oil contained in the high-temperature and high-pressure gasified refrigerant discharged from the compressor is separated from the refrigerant by means of the oil separator 21. The oil is retained in the separator 21 and is returned into the compressor through an oil returning pipe 22. The same device is arranged in the other outdoor units to return the oil into the respective compressors. The amounts of the oil returned to the respective compressors may be unequal to each other, depending upon the operating conditions of the respective compressors, with the result that some of the compressors may become short of supply of oil until they cause fusion-sticking. In order to avoid occurrence of such unequal supply of oil, the pressure equalizing pipe 9 and the oil equalizing pipe 10 are connected between the oil separators 21 of the respective outdoor units, thereby securing necessary amount of oil for the respective compressors. Thus, it is possible to avoid occurrence of fusion-sticking of the respective compressors owing to lack of amount of oil fed to the compressors.

Figure 6:
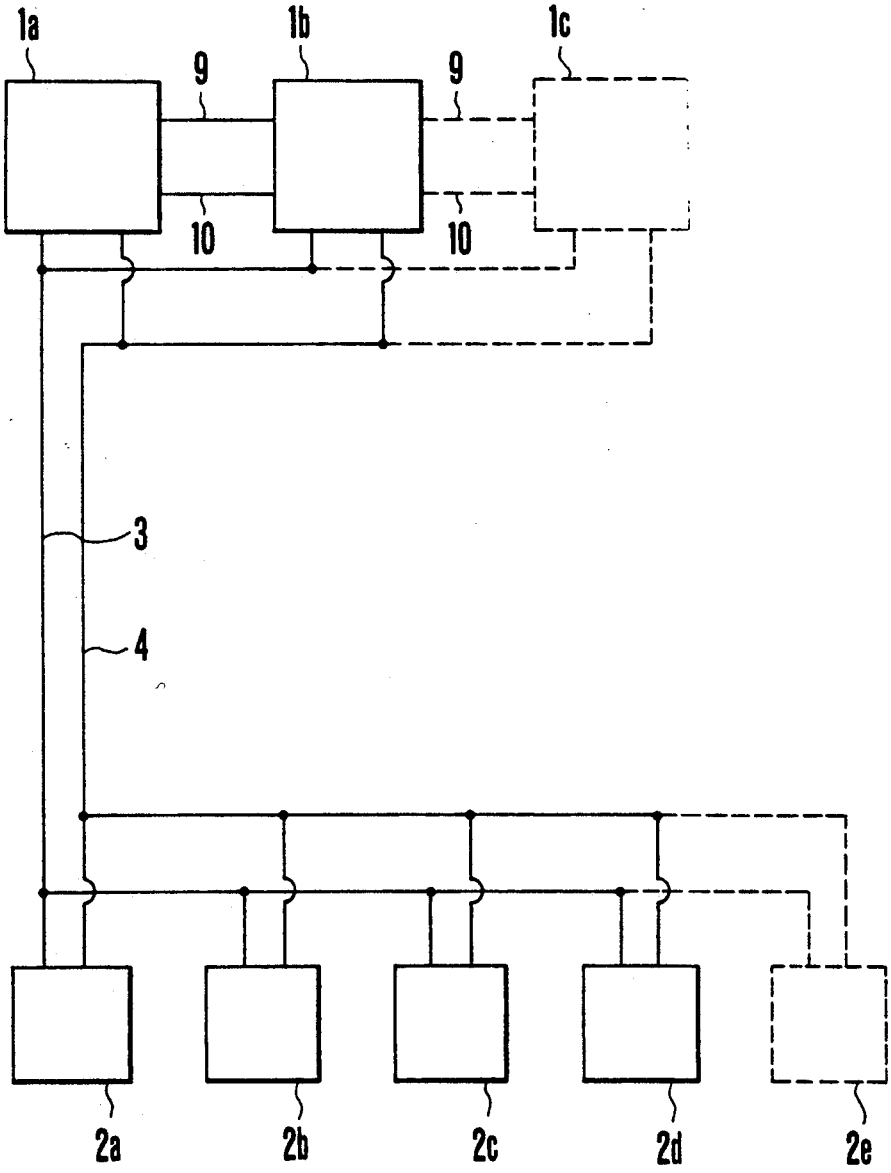
FIG. 6 illustrates an embodiment for increasing the numbers of the outdoor units and the indoor units.

FIG. 6 illustrates an embodiment of addition of the outdoor units and the indoor units of the a multi-airconditioner shown in FIGS. 1 and 2. In the embodiment shown in FIG. 6, refrigerant conveying conduits between the outdoor units 1*a* and 1*b* and the indoor units 2*a*, 2*b*, 2*c* and 2*d* are united into two conduits, as described above. When it is desired to add an outdoor unit 1*c* and an indoor unit 2*e*, it is sufficient to connect gasified refrigerant conduits and liquefied conduits of the outdoor unit 1*c* and the indoor unit 2*e* to the common gasified refrigerant conduit 4 and the common liquefied refrigerant conduit 3, respectively. It is not required to provide new refrigerant conveying conduits between the outdoor unit and the indoor unit, as in the case of the conventional multi-airconditioner. When it is desired to decrease the outdoor units and the indoor units, it is not required to remove any common refrigerant conveying conduit. Thus, it is possible to easily increase or decrease the outdoor units and the indoor units of the multi-airconditioner. When the number of the outdoor units is increased or decreased, the number of the pressure equalizing pipes 9 and the oil equalizing pipes 10 is increased or decreased.

Figure 7:
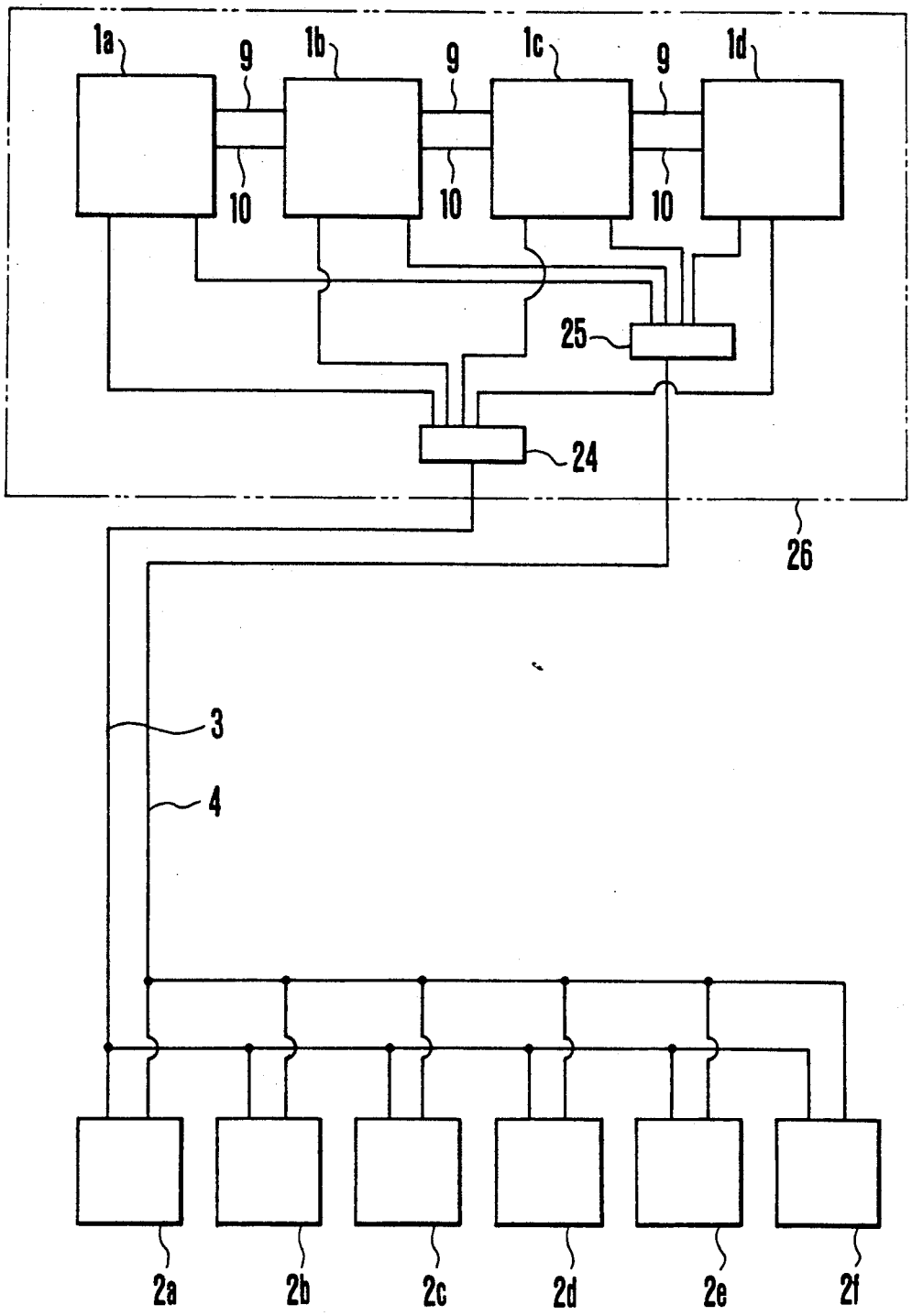
FIG. 7 illustrates an embodiment in which the liquefied refrigerant conduits and the gasified refrigerant conduits are united together by means of headers.

FIG. 7 illustrates a diagram of the refrigerant conveying conduits of the multi-airconditioner of the type shown in FIG. 1 in which the refrigerant conveying conduits of the respective ones of the plurality of outdoor units are united together so that the outdoor units operate as one set of outdoor units. In this embodiment, the liquid refrigerant conduits of the outdoor units 1*a*–1*d* are connected to a header 24 for outdoor unit liquefied refrigerant, while the gaseous refrigerant conduits are connected to a header 25 for outdoor unit gasified refrigerant, thereby forming a set of outdoor units 26. The refrigerant is conveyed between the set of outdoor units and the indoor units 2*a*–2*f* through a common liquefied refrigerant conduit 3 and a common gasified refrigerant conduit 4 which are connected to the headers 24 and 25. Thus, the number of conduits for conveying the refrigerant between the outdoor units and the indoor units can be reduced to two conduits.

Figure 8:
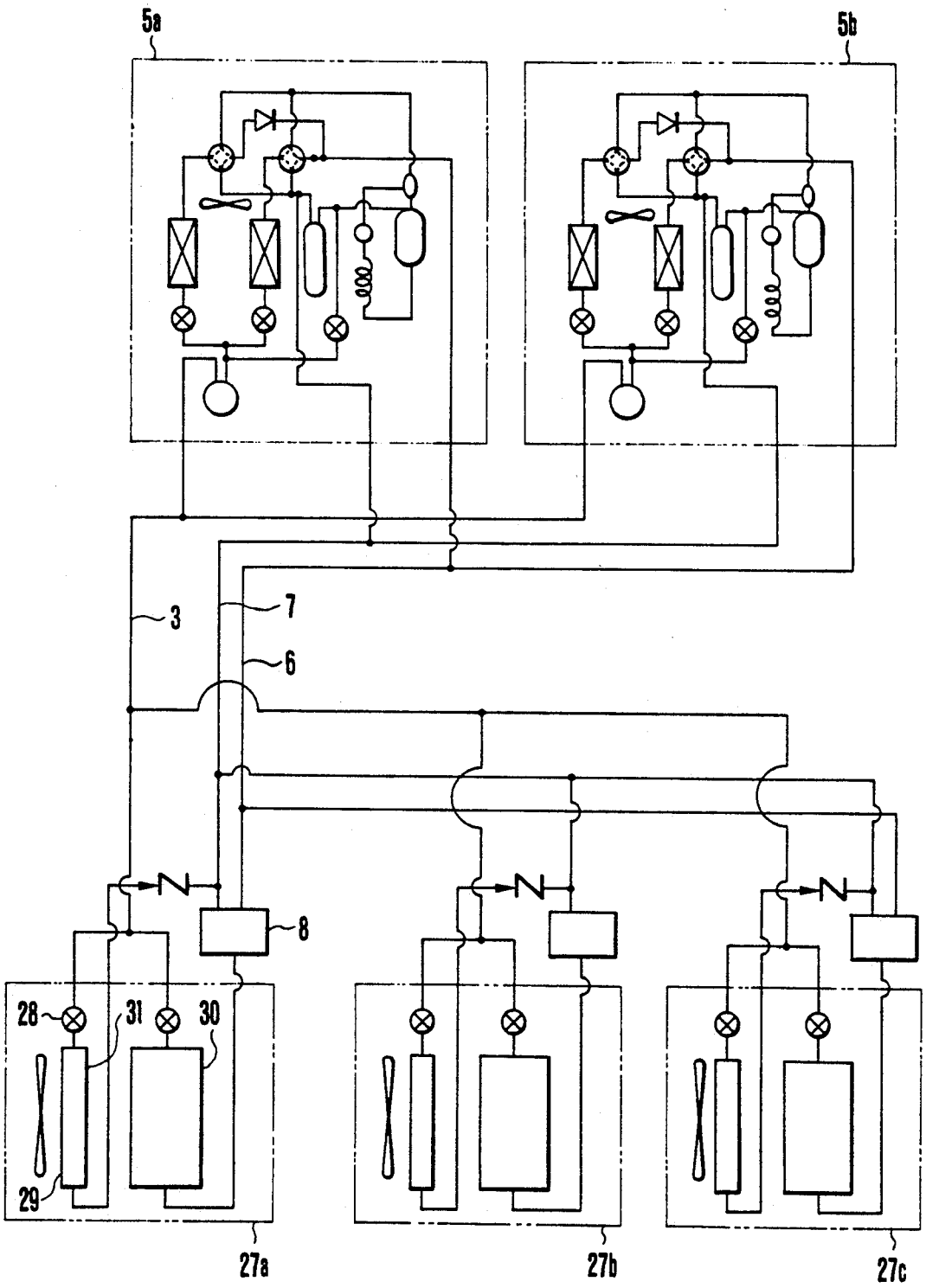
FIG. 8 illustrates a refrigerating cycle according to another embodiment of the present invention having a dehumidifying function.

FIG. 8 illustrates a refrigerant cycle diagram of the multi-airconditioner of the type shown in FIGS. 3 and 4 in which the conduits for conveying the refrigerant between the plurality of outdoor units and the plurality of indoor units are united into three conduits, and each of the indoor units 27*a*, 27*b* and 27*c* of the multi-airconditioner has a dehumidifying function. In this multi-airconditioner, the room air sucked into the indoor unit by means of a fan 31 is subjected to dehumidifying action by a dehumidifying heat exchanger 29. The temperature of the room air is reduced at this time, but a heat exchanger 30 serves as a condenser, thereby heating the room air. Thus the room air is subjected to dehumidifying action, without raising the room temperature.

Figure 9:
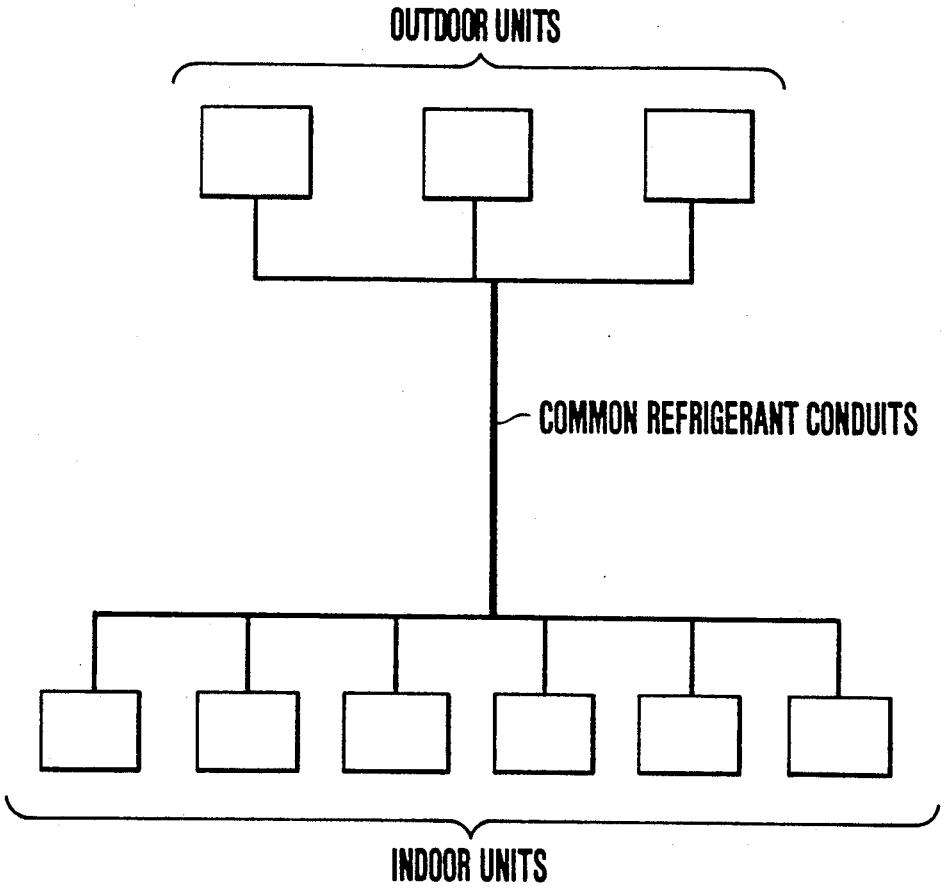
FIG. 9 is a diagram showing a concept of refrigerant conveying conduit uniting arrangement.

FIG. 9 is a diagram illustrating a concept of arrangement of refrigerant conveying conduits according to the present invention. As shown in FIG. 9, the plurality of outdoor units and the plurality of indoor units are connected together by the united common refrigerant conveying conduits (including the liquefied refrigerant conduit and the gasified refrigerant conduit; or the liquefied refrigerant conduit, the high-pressure gasified refrigerant conduit and the low-pressure gasified refrigerant conduit).

Figure 10:
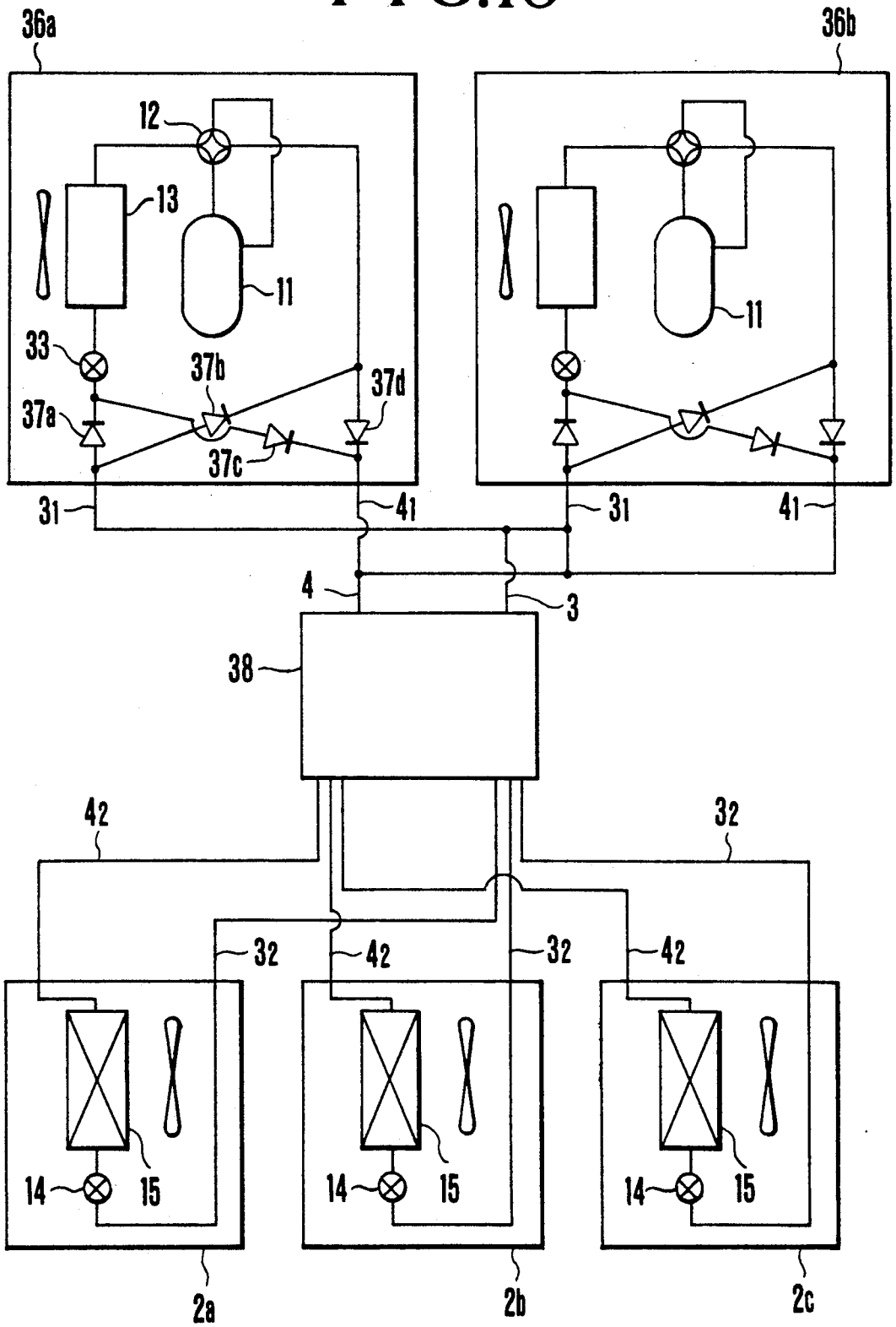
FIG. 10 illustrates a construction of a refrigerating cycle according to another embodiment of the present invention.

FIG. 10 illustrates another construction of a refrigerating cycle of a multi-airconditioner in which refrigerant conveying conduits connecting a plurality of outdoor units 36*a* and 36*b* and a plurality of outdoor units 2*a*, 2*b* and 2*c* are united to two conduits. In this embodiment, the refrigerant flowing in the conduit may be in the form of two phases, that is a gasified phase and a liquefied phase, whereby it is possible to effect simultaneous room-cooling and room-heating operation, by using two common conduits. In the following explanation, description will be given only to the refrigerating cycle in the case of the simultaneous room-cooling and room-heating operation and the descriptions concerning the simple room-cooling operation and the simple room-heating operation will be omitted.

In the case of the simultaneous room-cooling and room-heating operation where the room-cooling operation forms a basic operation, the over-heated gasified refrigerant discharged from a compressor 11 of the outdoor unit passes through a four-way valve 12 to an outdoor heat exchanger 13, which acts to exchange the heat of the refrigerant with that of the outdoor air, whereby the refrigerant becomes two-phase refrigerant, that is, a mixture of a gas-phase refrigerant and a liquid-phase refrigerant. The two-phase refrigerant passes through an expansion valve 33, a flow path control valve 37*c*, a gasified refrigerant conduit $4_1$, a common gasified refrigerant conduit 4 to a cooling-heating switching unit 38. The high-pressure two-phase refrigerant fed into the cooling-heating switching unit 38 is separated into the gasified refrigerant and the liquefied refrigerant by means of a gas-liquid separator. The liquefied refrigerant is fed through a liquefied refrigerant conduit $3_2$ of the indoor unit under room-cooling operation. It is fed to an expansion valve 14, which acts to reduce the pressure thereof, and then to an indoor heat exchanger 15, which serves to exchange the heat of the refrigerant with that of the air in the room whereby the refrigerant becomes a low-pressure gasified refrigerant. The low-pressure gasified refrigerant passes through the gasified refrigerant conduit $4_2$, the cooling-heating switching unit 38 into the common gasified refrigerant conduit 3 and then it passes through the liquefied refrigerant conduit $3_1$ to the outdoor unit. The gasified refrigerant fed to the outdoor unit passes through the flowing path control valve 37*b* and the four-way valve 12 to the compressor 11, which compresses the refrigerant again and discharges it in the form of a super-heated gaseous refrigerant.

On the other hand, the gasified refrigerant separated by the cooling-heating switching unit 38 passes through the gasified refrigerant conduit $4_2$ of the indoor unit under room-heating operation to the indoor unit under room-heating operation. Then the heat exchanger 15 serves to exchange the heat of the refrigerant with that of the air in the room, whereby the refrigerant becomes a liquefied refrigerant, which passes through the expansion valve into the liquefied refrigerant conduit $3_2$. The liquefied refrigerant, which has passed from the liquefied refrigerant conduit $3_2$ into the cooling-heating switching unit 38, is mixed with the liquefied refrigerant, which has been separated by the gas-liquid separator, and it is used as a refrigerant for room cooling in the indoor unit under room-cooling operation. The refrigerant becomes a low-pressure gasified refrigerant, which passes through the same path as explained above and returns to the compressor 11 of the outdoor unit.

In the case of the simultaneous cooling and heating operation where the room-heating operation forms a basic operation, the super-heated gaseous refrigerant discharged from the compressor 11 passes through the four-way valve 12, the flowing path control valve 37*d*, the gasified refrigerant conduit $4_1$ and the common gasified refrigerant conduit 4 to the cooling-heating switching unit 38. The gasified refrigerant, which has passed from the cooling-heating switching unit 38 into the gasified refrigerant conduit $4_2$ of the indoor unit under room-heating operation, is fed to the indoor unit under room-heating operation and the heat exchanger 15 in said indoor unit serves to exchange the heat of the refrigerant with that of the air in the room. The refrigerant becomes a liquefied refrigerant, which passes through the expansion valve 14, the liquefied refrigerant conduit $3_2$ to the cooling-heating switching unit 38. A part of the liquefied refrigerant fed into the cooling-heating switching unit 38 passes into the liquefied refrigerant conduit $3_2$ of the indoor unit under room-cooling operation and to the indoor unit under room-cooling operation. The expansion valve 14 in said indoor unit serves to reduce the pressure of the refrigerant and the heat exchanger 15 acts to exchange the heat of the refrigerant with that of the air in the room. The refrigerant becomes a low-pressure gasified refrigerant, which passes through the gasified refrigerant conduit $4_2$ into the cooling-heating switching unit 38. The gasified refrigerant, fed into the cooling-heating switching unit 38, joins with the liquefied refrigerant retained in the cooling-heating switching unit 38 and then passes through the common liquefied refrigerant conduit 3 and the liquefied refrigerant conduit $3_1$ to the outdoor unit. Then, the refrigerant passes through the flowing path control valve 37*a* to the expansion valve 33, which serves to reduce the pressure of the refrigerant, and then to the outdoor heat exchanger, which serves to exchange the heat of the refrigerant with that of the outdoor air. The refrigerant becomes a gasified refrigerant, which passes through the four-way valve 12 into the compressor 11, which compresses the refrigerant again and discharges it in the form of a super-heated gas.

Figure 11:
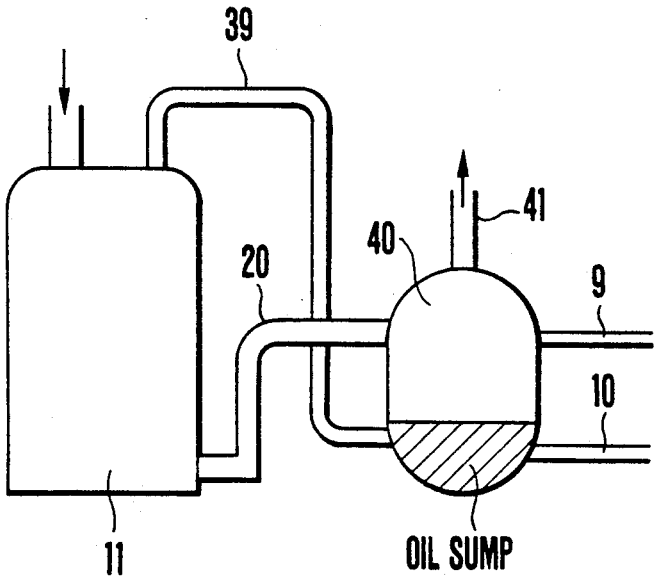
FIG. 11 illustrates another arrangement for equalizing oil feeding amounts between the respective outdoor units.

FIG. 11 illustrates an embodiment of the multi-airconditioner according to the present invention which includes a device for avoiding imbalance of amounts of oil fed to the compressors of the type in which the oil is fed from the outside of the compressor. In this embodiment, by adopting the compressors of outside oil feeding type, the non-operating compressor is prevented from accumulating the oil therein, so that occurrence of fusion-sticking of some compressor owing to the imbalance of the amounts of oil fed to the compressors can be avoided. In FIG. 11, the super-heated refrigerant discharged from the compressor 11 in the outdoor unit passes through a discharge pipe 20 into an oil separator 40. In the oil separator, the oil and the refrigerant are separated from each other and the separated refrigerant is fed through a discharge pipe 41 to the indoor unit and the outdoor unit heat exchangers, for the purpose of room-cooling or room-heating. On the other hand, the oil retained in the oil separator 40 is fed through a oil retained in the oil separator 40 is fed through a oil feeding pipe 39 to the compressor 11. The oil separators 40 of the respective outdoor units are communicated with each other through a pressure equalizing pipe 9 and an oil equalizing pipe 10, so that non-uniform accumulation of oil between the respective oil separators 40 cannot occur. Thus, the occurrence of fusion-sticking of any compressor owing to the imbalance of amounts of oil fed to the compressors can be avoided.

In the multi-airconditioner as explained above, the common conduits are in the form of two or three conduits. The arrangement of these common conduits may be formed by bundling two or more separate tubes or may be formed by a single tube within which two or three conduits are formed.

As explained above, the present invention provides a multi-airconditioner comprising a plurality of outdoor units and a plurality of indoor units, in which the number of refrigerant conveying conduits can be reduced. Accordingly, the piping work can be simplified, the amount of piping used can be reduced, and the space in a building used for the piping can be reduced. Furthermore, the number of the outdoor units and/or the indoor units can be very easily increased or decreased.

In the multi-airconditioner according to the present invention, an indoor unit is not associated with a particular indoor unit or particular indoor units but is associated with any indoor unit or any one of a group of indoor units and, consequently this multi-airconditioner has good flexibility in utilization and operation thereof.

What is claimed is:

1. A multi-air conditioner including a plurality of outdoor units and a plurality of indoor units, each of said outdoor units and each of said indoor units including a liquefied refrigerant conduit and a gasified refrigerant conduit, and wherein liquefied refrigerant conduits and gasified refrigerant conduits of the respective outdoor units and the liquefied refrigerant conduit and the gasified refrigerant conduit of the indoor units are respectively connected with a common liquefied refrigerant conduit and a common gasified refrigerant conduit, respectively.

2. A multi-air conditioner including a plurality of outdoor units and a plurality of indoor units, each of said outdoor units having a refrigerant delivering conduit and a refrigerant returning conduit, each of said indoor units having a liquefied refrigerant conduit and a gasified refrigerant conduit, wherein the refrigerant delivering conduit and the refrigerant returning conduit of each of the outdoor units are connected to a common refrigerant delivering conduit and a common coolant returning conduit, respectively, said common refrigerant delivering conduit and said common refrigerant returning conduit being connected, at their indoor unit side, to a gas-liquid separator for separating a refrigerant fed from the common refrigerant delivering conduit into a gas phase refrigerant and a liquid phase refrigerant when said refrigerant contains the gas phase refrigerant and the liquid phase refrigerant, said gas-liquid separator being connected to the liquefied refrigerant conduit and the gasified refrigerant conduit of the respective indoor units.

3. A multi-air conditioner according to claim 1 or 2, wherein the conduits of the respective outdoor units are connected to said common conduits through headers, respectively.

4. A multi-air conditioner according to claim 1 or 3, said multi-air conditioner further including an oil-separator connected to a discharging pipe of a compressor in each of the outdoor units and a pressure equalizing pipe and an oil equalizing pipe connected to the oil-separator of each of the respective outdoor units.

5. A multi-air conditioner according to claim 1 or 3, wherein said multi-air conditioner further includes an outside oil feeding system used to feed oil to a compressor in each of the outdoor units, a pressure equalizing pipe and an oil equalizing pipe connected to an oil-separator of each of the respective outdoor units.

6. A multi-air conditioner according to claim 3, said multi-air conditioner further including an oil-separator connected to a discharging pipe of a compressor in each of the outdoor units and a pressure equalizing pipe and an oil equalizing pipe connected to the oil-separator of each of the respective outdoor units.

7. A multi-air conditioner according to claim 3, wherein said multi-air conditioner further includes an outside oil feeding system used to feed oil to a compressor in each of the outdoor units, a pressure equalizing pipe and an oil equalizing pipe connected to an oil-separator of each of the respective outdoor units.

8. A multi-air conditioner including a plurality of outdoor units, a dehumidifier and a plurality of indoor units, each of said outdoor units having a liquified refrigerant conduit and a gasified refrigerant conduit, each of said indoor units having a liquefied refrigerant conduit and a gasified refrigerant conduit, and wherein the liquified refrigerant conduit and the gaseous refrigerant conduit of each of the outdoor units and the liquified refrigerant conduit and gasified refrigerant conduit of respective indoor units are connected to a common refrigerant delivering conduit and a common coolant returning conduit, respectively, said common refrigerant delivering conduit and said common refrigerant returning conduit being connected, at their indoor unit side, to a gas-liquid separator for separating a refrigerant fed from the common refrigerant delivering conduit into a gas phase refrigerant and a liquid phase refrigerant when said refrigerant contains the gas phase refrigerant and the liquid phase refrigerant, said gas-liquid separator being connected to the liquefied refrigerant conduit and the gasified refrigerant conduit of the respective indoor units.

* * * * *